US010874197B2

(12) United States Patent
Panza, III

(10) Patent No.: US 10,874,197 B2
(45) Date of Patent: Dec. 29, 2020

(54) REMOVABLY ATTACHABLE REFLECTIVE COVERING

(71) Applicant: Ernest Peter Panza, III, Las Vegas, NV (US)

(72) Inventor: Ernest Peter Panza, III, Las Vegas, NV (US)

( * ) Notice: Subject to any disclaimer, the term of this patent is extended or adjusted under 35 U.S.C. 154(b) by 0 days.

(21) Appl. No.: 16/453,425

(22) Filed: Jun. 26, 2019

(65) Prior Publication Data

US 2019/0387865 A1 Dec. 26, 2019

Related U.S. Application Data

(60) Provisional application No. 62/690,002, filed on Jun. 26, 2018, provisional application No. 62/789,591, filed on Jan. 8, 2019.

(51) Int. Cl.
*A45F 3/04* (2006.01)
*A45F 3/00* (2006.01)

(52) U.S. Cl.
CPC ..... *A45F 3/04* (2013.01); *A45F 2003/003* (2013.01)

(58) Field of Classification Search
CPC ..... A41D 13/01; A41D 15/04; G08B 5/004; A45F 2003/146; A45F 3/14
See application file for complete search history.

(56) References Cited

U.S. PATENT DOCUMENTS

| | | | | |
|---|---|---|---|---|
| 9,410,694 | B2 * | 8/2016 | Curran | H05B 45/10 |
| 9,664,372 | B1 * | 5/2017 | Rothschild | F21V 33/0008 |
| 2005/0045687 | A1 * | 3/2005 | Willows | G08B 5/004 224/637 |
| 2005/0133558 | A1 * | 6/2005 | Toombs | A45C 13/002 224/576 |
| 2017/0055683 | A1 * | 3/2017 | Willows | A45F 3/14 |
| 2019/0037934 | A1 * | 2/2019 | Swank | A41D 13/01 |
| 2019/0350277 | A1 * | 11/2019 | Mahoney | A45F 4/12 |

* cited by examiner

*Primary Examiner* — Corey N Skurdal
(74) *Attorney, Agent, or Firm* — Gurr Brande & Spendlove, PLLC; Robert A. Gurr

(57) ABSTRACT

A removably attachable reflective covering has an upper end and a lower end. The upper end and lower end may be removably attached to the upper end and lower end of a backpack or other item, respectively. The removably attachable reflective covering having a device attachment site to carry a light or GPS tracking device. The upper end has a void that can be inverted and receive the lower end and closed to completely enclose the lower end, allowing the removably attachable reflective covering to be conveniently stored.

1 Claim, 16 Drawing Sheets

REMOVABLY ATTACHABLE REFLECTIVE COVERING

CROSS-REFERENCE TO RELATED APPLICATIONS

This application claims the benefit of U.S. Provisional Application Ser. No. 62/690,002, filed on Jun. 26, 2018 and U.S. Provisional Application Ser. No. 62/789,591 filed Jan. 8, 2019, both of which are incorporated herein by reference.

TECHNICAL FIELD

The present disclosure relates generally to safety apparel and gear. More particularly, the present disclosure relates to a reflective covering that is removably attachable to backpacks, bags, and other items.

BACKGROUND

In recent years, our society has seen a significant increase in outdoor recreation, particularly in the areas of cycling, motorcycling, running, hiking, walking, and other similar activities. These activities are not limited to the daytime, with many people participating at dawn, dusk, and night. Other activities, such as walking or skateboarding to and from a school campus, may also be done in low-light or dark conditions. As the population of automobiles continues to grow, the interaction between individuals and vehicles continues to increase. A number of factors contribute to safety concerns, including low-light or dark conditions, distracted driving, inexperienced drivers, or even drivers under the influence of drugs or alcohol. Safety is a paramount concern as vehicles may not be able to see pedestrians, whether at night or in the day.

Attempts have been made to address the above-listed safety concerns. For example, reflectors are common on bicycles, but those don't help those not on a bike, such as a runner. To overcome this problem, reflective vests or clothing with integrated reflective materials have been developed. However, a reflective vest or reflective clothing is obscured when the wearer uses a backpack or, additional clothing for protection from the cold, wind, or road rash. The prior art includes backpacks or other bags with integrated reflective material. However, this presents the additional problem that each backpack a person owns must include the reflective material to get the desired protection. An attempt to address this problem has been disclosed in the prior art with the use of reflective backpack covers. These covers go over an entire backpack and make the backpack's compartments and compartment fasteners inaccessible. They do include a separate bag for storage; however, the user must keep track of that separate bag for it to be useful. Further, the covers are limited to being reflective, and do not have additional features to be seen from extended distances or without light causing a reflection.

As such, despite the prior art's attempts, there remains a need for a reflective covering that will not be obstructed by the use of additional clothing, a backpack, or other bag. There also remains the need for a reflective covering that can be seen by all sides, is one size fits all, that can be removably attached, that allows for access to a backpack or other bag's compartments and compartment fasteners, and that can be conveniently stored without the need for a separate bag. The present disclosure seeks to solve these and other problems.

SUMMARY OF EXAMPLE EMBODIMENTS

In one embodiment, a removably attachable reflective covering comprises an upper end and lower end, as well as a front side and a backside. The upper end comprises two pieces affixed to each other on three edges, with the fourth edge creating a void where the covering can be folded inside of itself for convenient storage. The upper end comprises a drawstring with a closing mechanism to contain the removably attachable reflective covering. Affixed to each of the upper end and lower end is a strap that allows the upper end and the lower end to each be removably attachable to a backpack or other object. Attached to the lower end is a stretchable loop with at least two straps and a size-adjustment mechanism.

In one embodiment, a removably attachable reflective covering comprises a device attachment site on the front side where a light and/or a GPS tracking device is removably attachable.

In one embodiment, a method of storing a removably attachable reflective covering comprises forming a bag using a first end and fitting a lower end into the newly formed bag. A void may be formed at an upper end of a removably attachable reflective covering, the void may then be inverted to receive the entire lower end, with a closing mechanism engaged to secure the entire lower end inside of the inverted void and storage bag. The void and the closing mechanism creating the storage bag for the removably attachable reflective covering.

In one embodiment, a removably attachable reflective strap apparatus comprises a first strap and a second strap. The first strap and second strap are configured to couple to one another. In one embodiment, the first strap may have an opening at the center thereof for receiving the second strap. In one assembled configuration, the removably attachable reflective strap has a cross formfactor. Further, each strap may be reflective or may be capable of having a reflective component coupled thereto. In one embodiment, a first reflective strap may couple to first strap and second reflective strap may couple to second strap. The removably attachable reflective strap apparatus can be attached over a backpack by coupling the ends of the first strap around the horizontal center or circumference of the backpack, from its front to back. The second strap may be coupled around the vertical center of the backpack, from its top to bottom.

In one embodiment, a removably attachable reflective strap apparatus comprises a light that is removably attachable to the front side of either the first or second strap. In one embodiment, the light is coupled to the center of the cross formed by the first and second straps. In one embodiment, a GPS unit may be coupled to the removably attachable reflective strap apparatus.

In one embodiment a removably attachable reflective strap cover comprises malleable material that can be attached over the straps of a backpack or other bag. The removably attachable reflective strap cover may have hooks and loops on a front side and a back side of a first edge and hooks and loops on a front side and a back side of a second edge. The removably attachable reflective strap cover may then surround or encompass the strap of a backpack where the first edge may be coupled to the second edge using the hooks and loops.

In one embodiment, the removably attachable reflective strap cover comprises a removable reflective strip that can be attached separately with any desired coupling mechanism. In one embodiment, the front side may comprise colors or graphics that differ from the back side, allowing it to be reversible.

DETAILED DESCRIPTION OF EXAMPLE EMBODIMENTS

Figure 1:
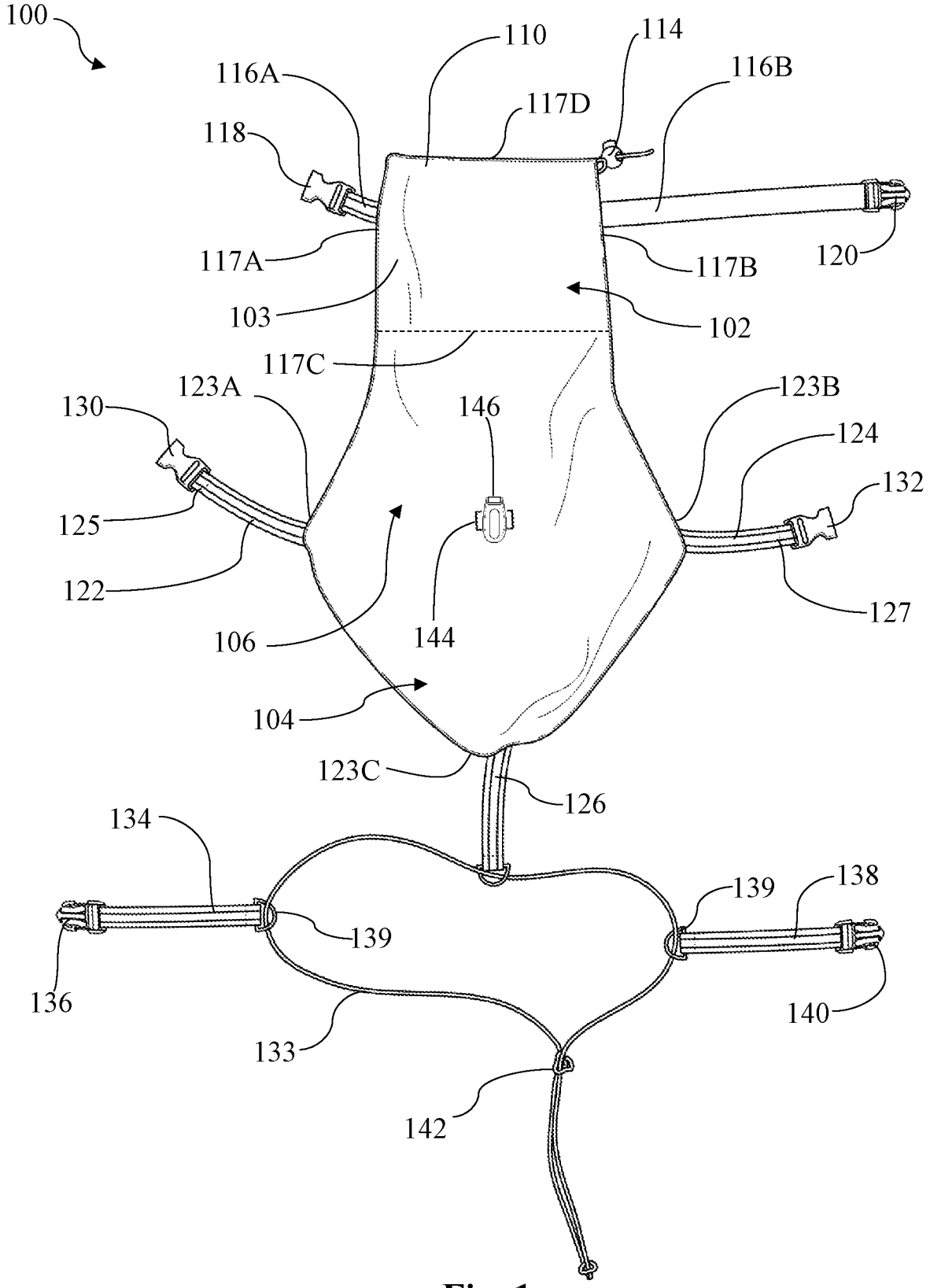
FIG. 1 is a front elevation view of a removably attachable reflective covering.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As previously described, despite the prior art's attempts, there remains a need for a reflective covering that will not be obstructed by the use of additional clothing, a backpack, or other bag. There also remains the need for a reflective covering that can be seen on all sides, is one size fits all, that can be removably attached, that allows for access to a backpack or other bag's compartments and compartment fasteners, and that can be conveniently stored without the need for a separate bag. The present disclosure seeks to solve these and other problems.

Figure 2:
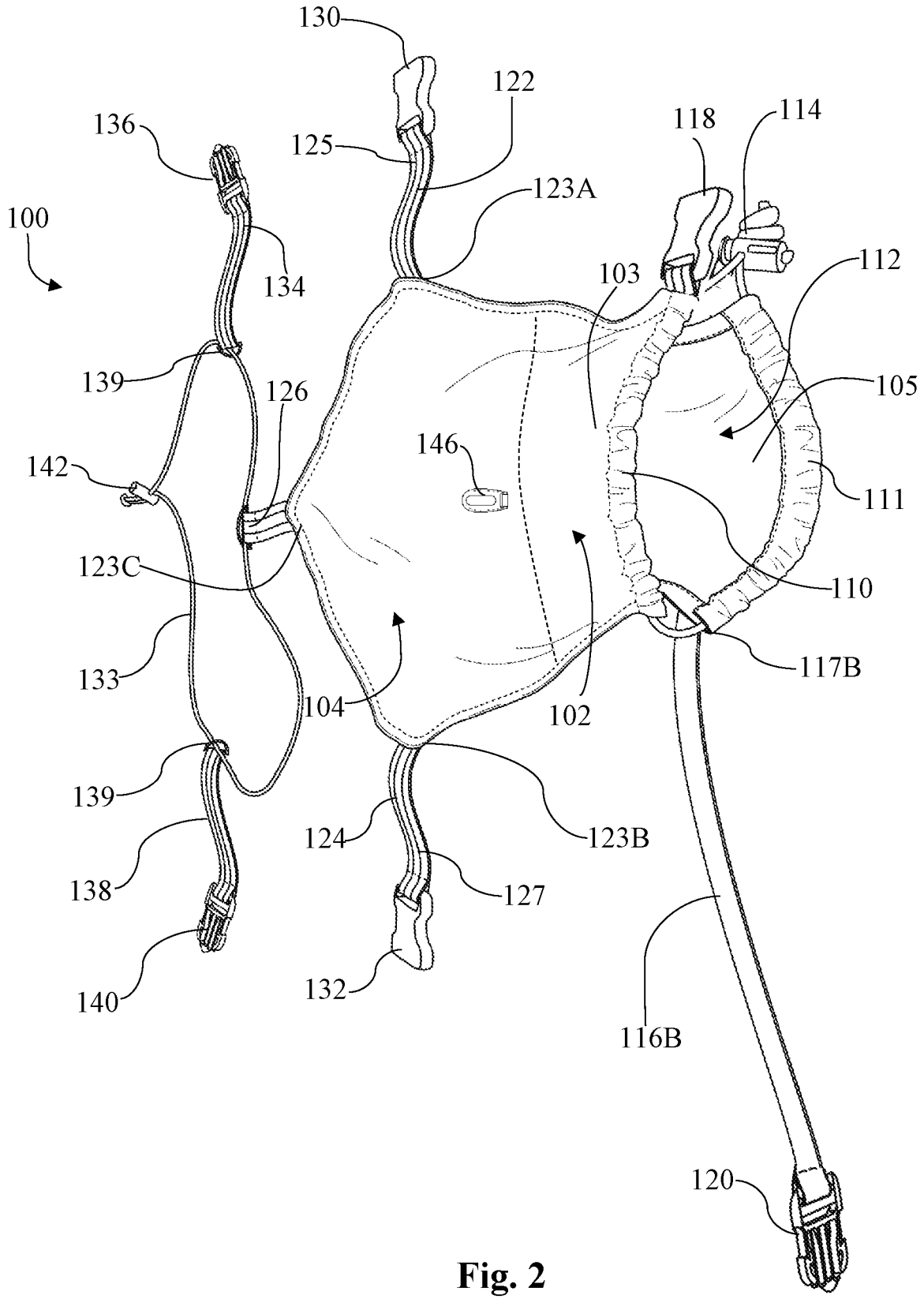
FIG. 2 is a top perspective view of a removably attachable reflective covering.
Figure 3:
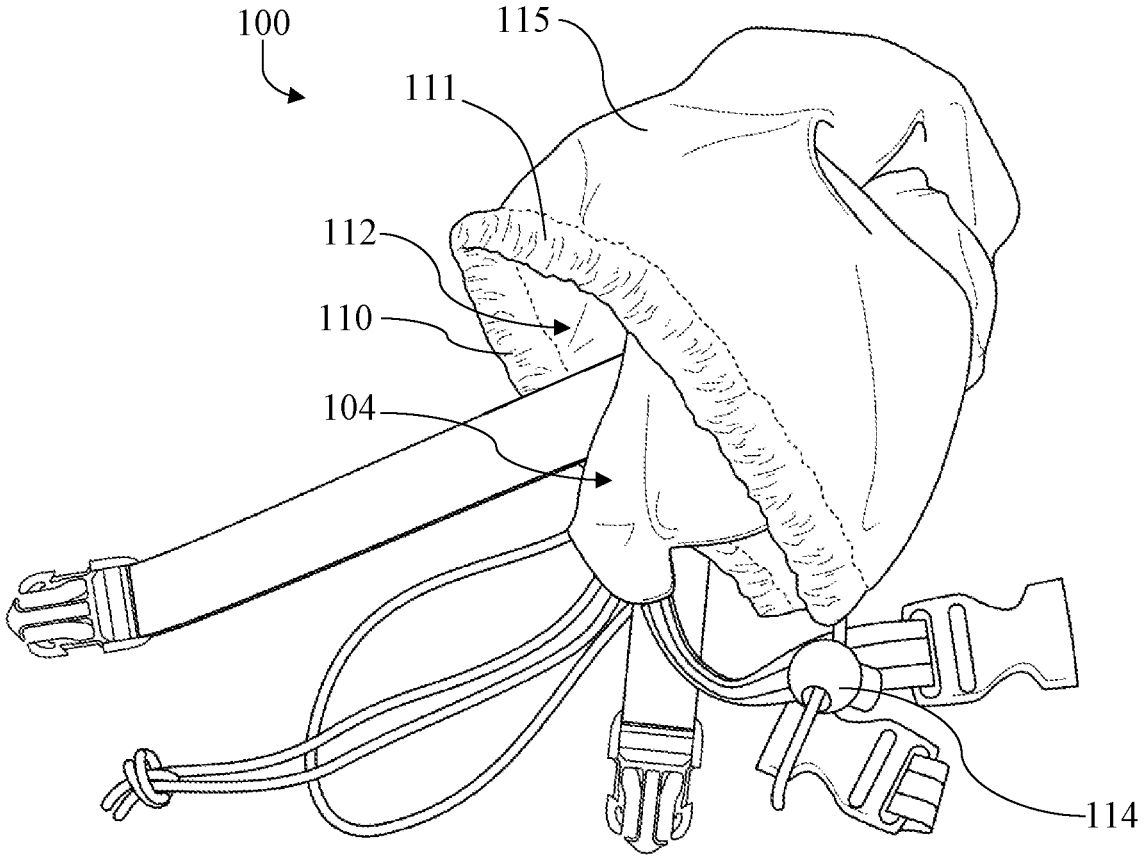
FIG. 3 is a top perspective view of an inverted and partially stored removably attachable reflective covering.
Figure 4:
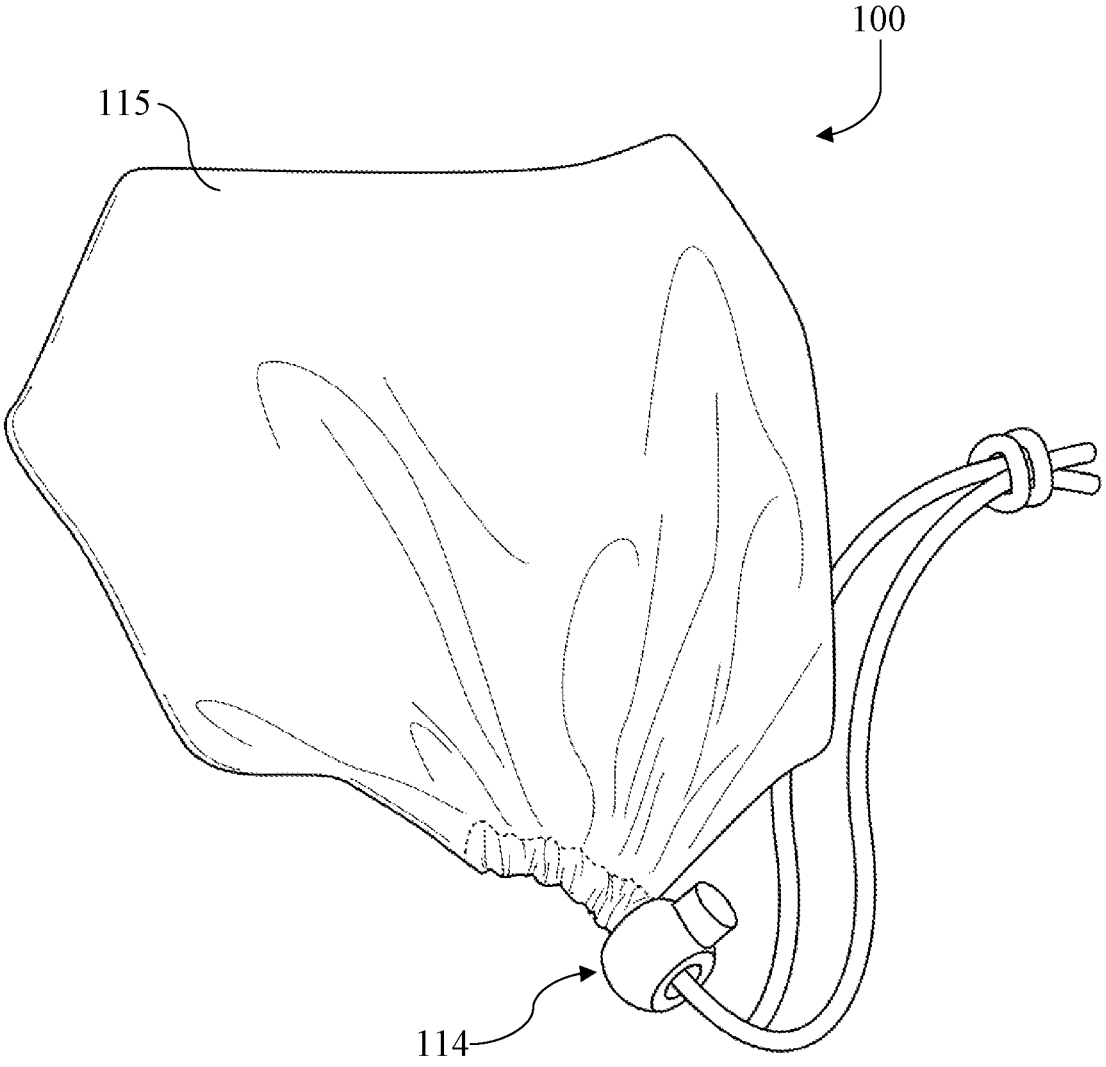
FIG. 4 is a side perspective view of a closed removably attachable reflective covering.
Figure 5:
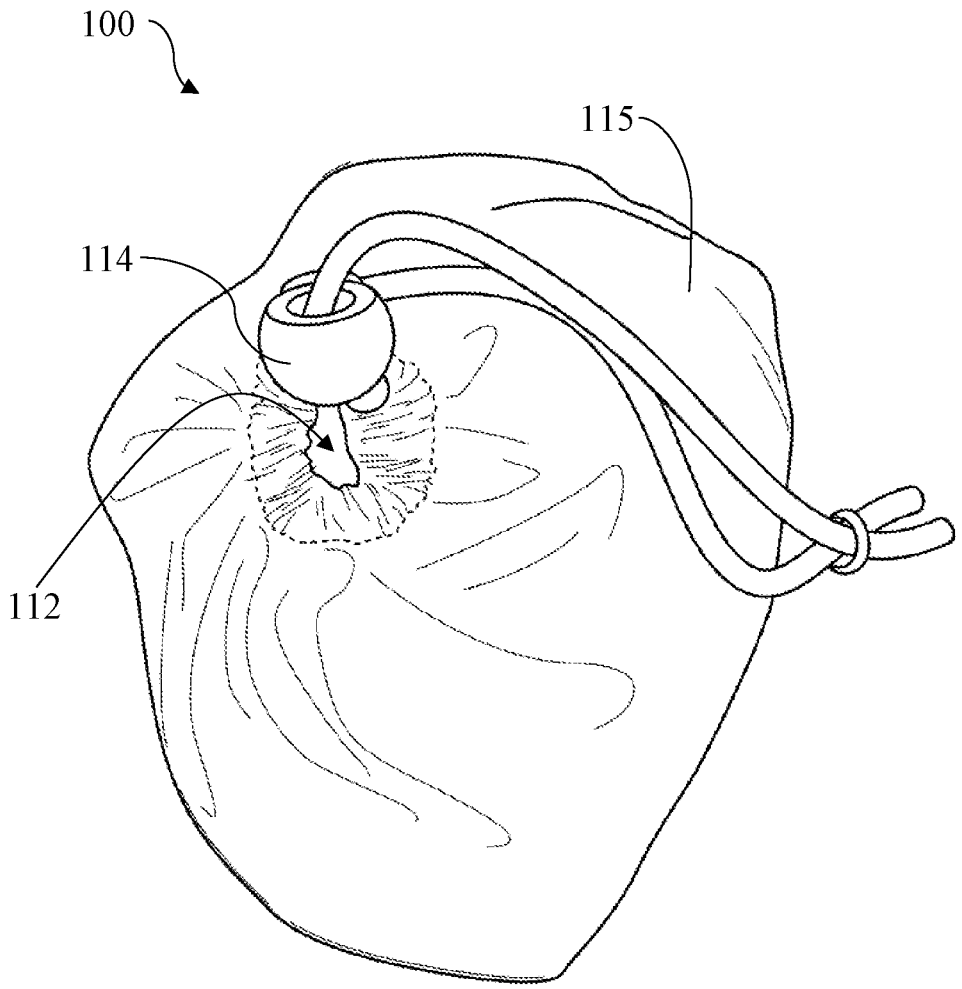
FIG. 5 is a top perspective view of a closed removably attachable reflective covering.

In one embodiment, as generally shown in FIGS. 1-8, a removably attachable reflective covering 100 comprises an upper end 102, a lower end 104, a front side 106 and a back side (a mirror image of the front side 106). As best seen in FIG. 2, the upper end 102 comprises a first wall 103 and a second wall 105 (FIG. 2) fastened together on three edges 117A, 117B, 117C, respectively, thereby forming a void 112 on a fourth edge 117D accessible by separating the first top edge 110 of the first wall 103 from the second top edge 111 of the second wall 105 of the removably attachable reflective covering 100. The void 112 is closeable using a closing mechanism 114, such as a drawstring with spring-loaded clamp, interlocking teeth, hooks and loops, interlocking groove and ridge, or other closure mechanisms. It will be appreciated that, as shown in FIG. 3, the void 112 can be inverted and can receive the entire lower end 104 therein. As shown in FIGS. 4-5, the closing mechanism 114 may be engaged to secure the entire lower end 104 inside of the inverted void 112. The void 112 and the closing mechanism 114 creating the storage bag 115 (which is inverted upper end 102) of the removably attachable reflective covering 100.

Referring back to FIG. 1, the upper end 102 comprises first upper strap 116A and second upper strap 116B with first upper strap 116A connected on a first edge 117A of upper end 102 and second upper strap 116B connected to the opposite edge 117B of upper end 102. Attached to strap 116A is a coupling device (e.g., female coupler 118) that can be coupled to a mating coupling device (e.g., male coupler 120) attached to strap 116B so that the upper end 102 may be removably attached to any object. The lower end 104 comprises a first lower strap 122 on a first lower edge 123A, a second lower strap 124 on second lower edge 123B, and a third lower strap 126 on bottom edge 123C. Attached to the distal end 125 of first lower strap 122 is a female coupler 130. Attached to the distal end 127 of second lower strap 124 is a female coupler 132. Coupled to third lower strap 126 is a stretchable (e.g., elastic) loop 133 that comprises a first loop strap 134 with the male coupler 136 attached thereto, and a second loop strap 138 with the male coupler 140 attached thereto. First loop strap 134 and second loop strap 138 may be slidable or otherwise selectively positionable on stretchable loop 133, such as by using ring couplers 139. Attached to stretchable loop 133 is a size-adjusting mechanism 142 (e.g., spring-loaded clamp) that allows for the adjustment of the size of stretchable loop 133, which allows for customization for a variety of sizes of backpacks.

Figure 6:
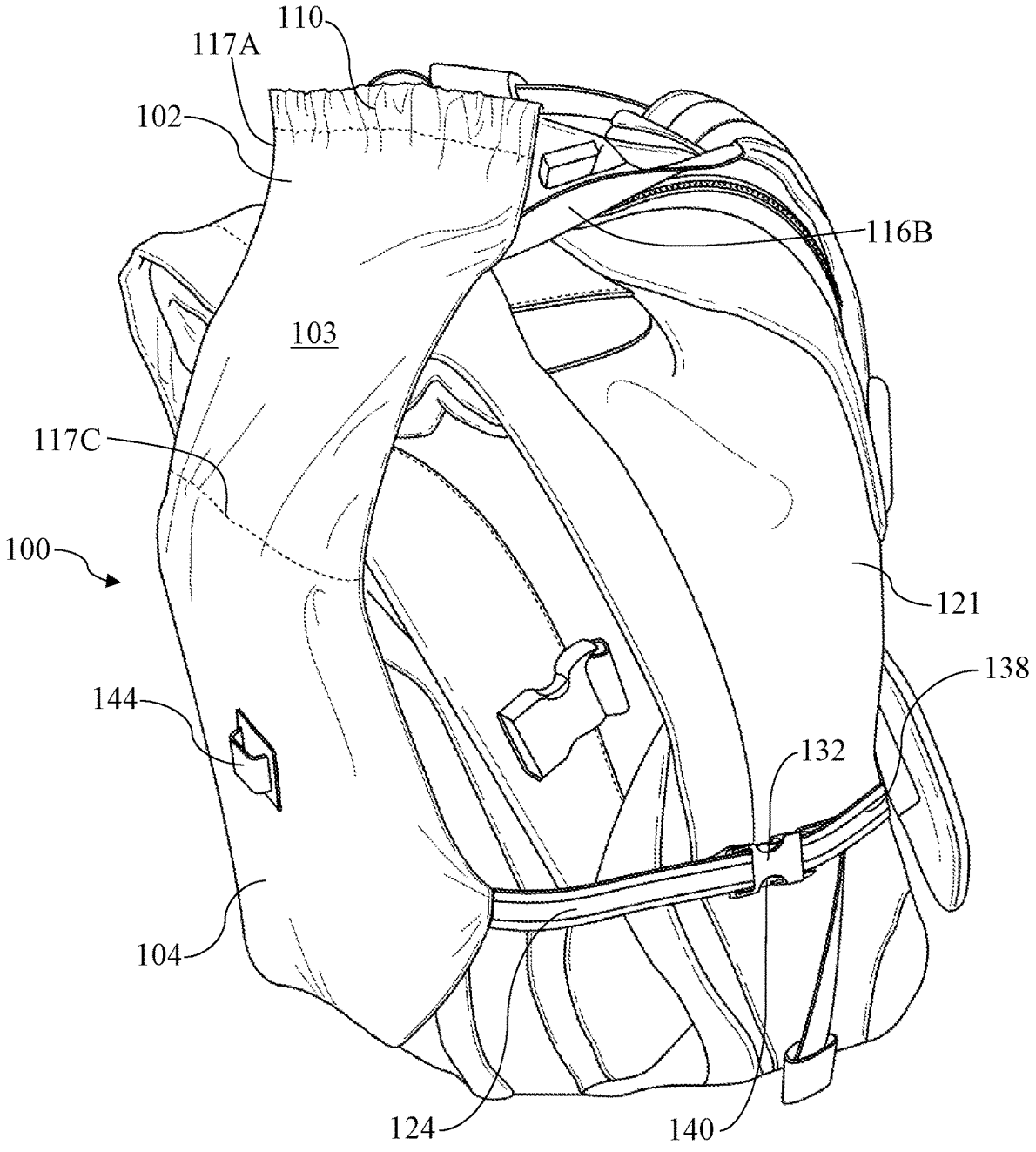
FIG. 6 is a front perspective view of a removably attachable reflective covering coupled to a backpack.
Figure 7:
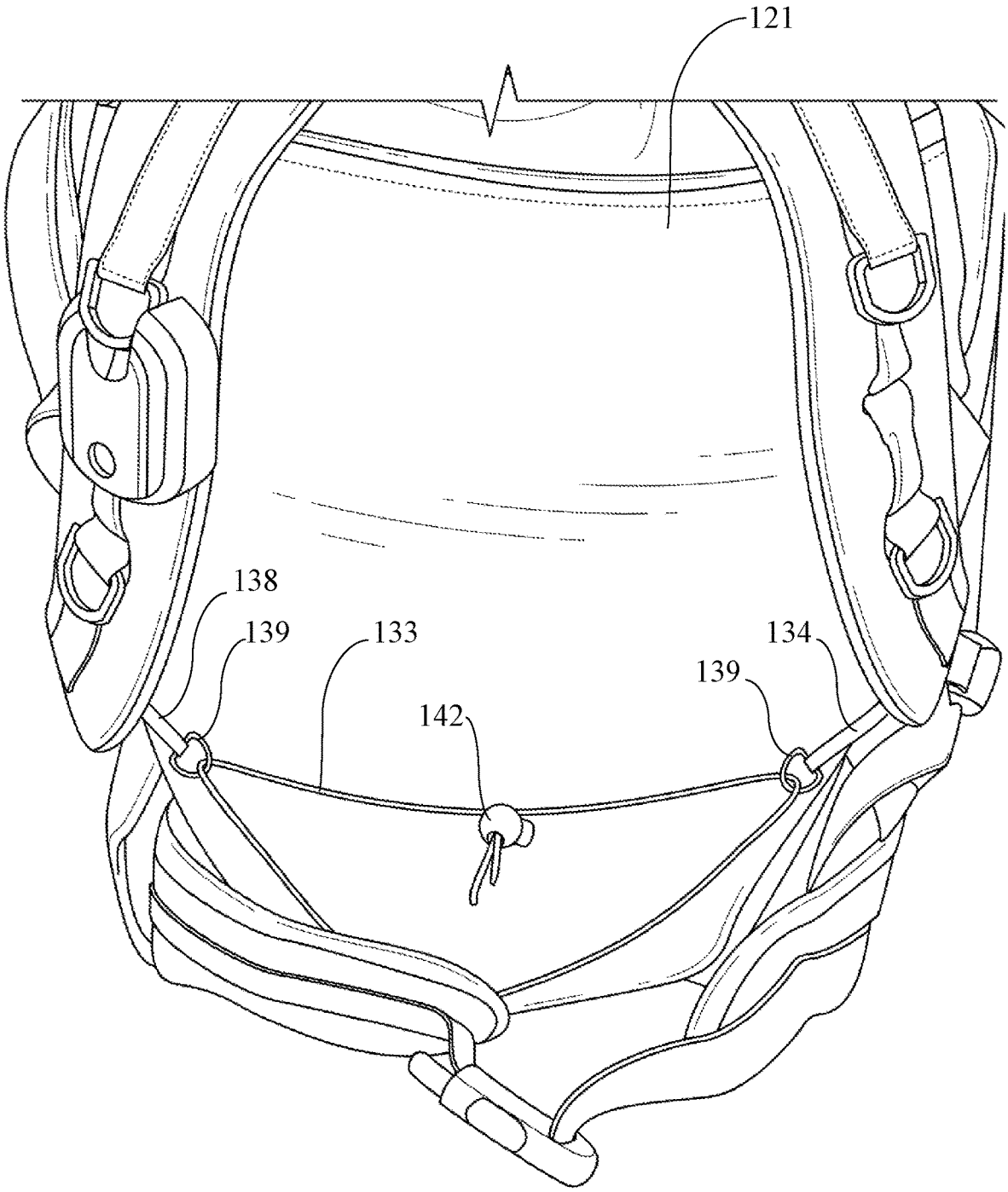
FIG. 7 is a rear perspective view of a stretchable loop and size-adjusting mechanism of a removably attachable reflective covering coupled to a backpack.
Figure 8:
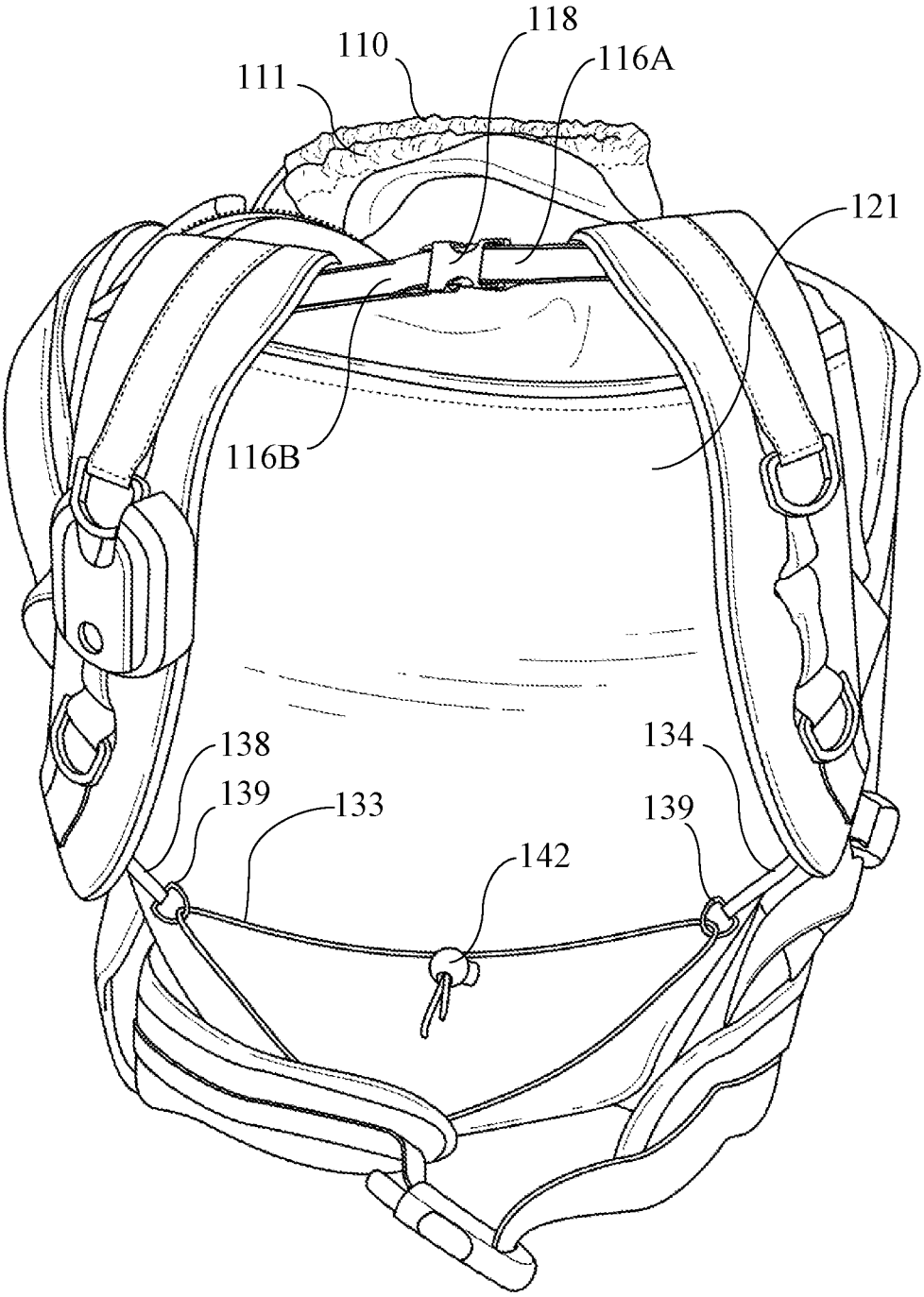
FIG. 8 is a rear perspective view of a stretchable loop, size-adjusting mechanism, and an upper strap of a removably attachable reflective covering coupled to a backpack.
Figure 9:
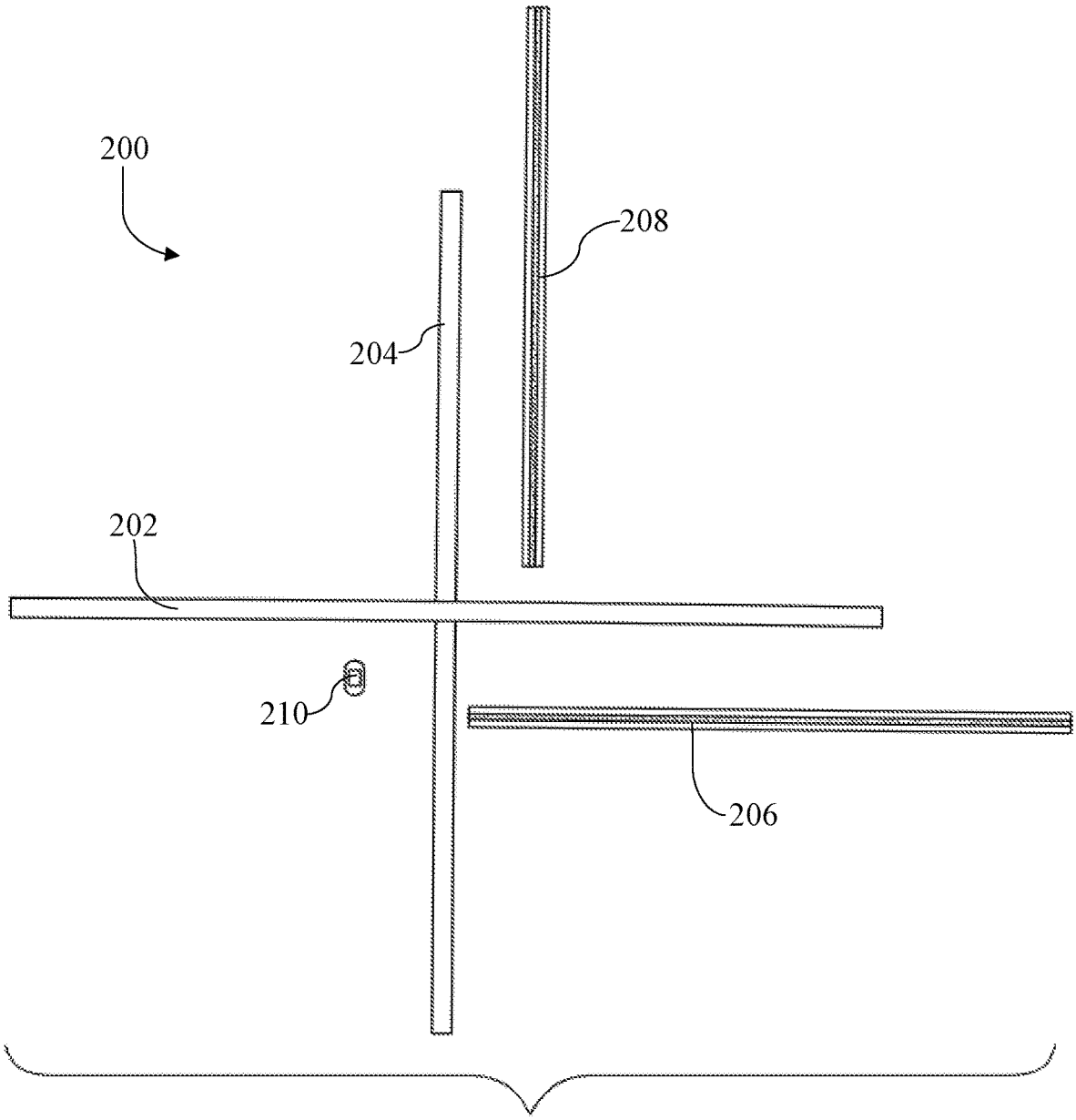
FIG. 9 is a front perspective view of a removably attachable reflective strap apparatus disassembled.
Figure 10:
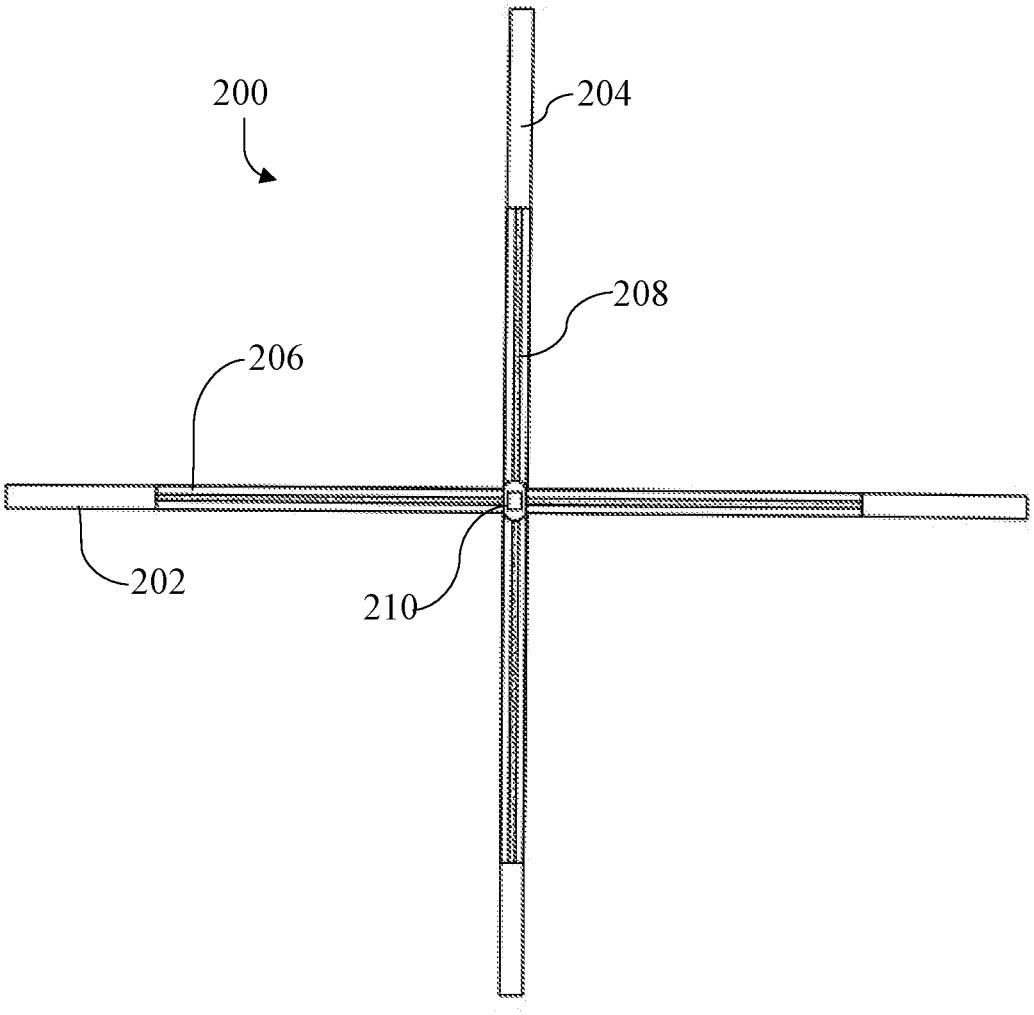
FIG. 10 is a front perspective view of a removably attachable reflective strap apparatus assembled.

FIGS. 6-8 illustrate the removably attachable reflective covering 100 coupled to a backpack 121. While plastic side release buckles (e.g., female coupler 118 and male coupler 120), may be the preferred attachment device, other coupling devices may be utilized (e.g., hooks and loops, snaps, etc.).

In one example, the removably attachable reflective covering 100 may be placed on the exposed side of a backpack 121 (i.e., the side opposite a user). The first upper strap 116A and second upper strap 116B may then extend around the circumference of the backpack 121 and be coupled together under the backpack straps, as shown in FIG. 8. The stretchable loop 133 is extended around the bottom of the backpack 121 to the side proximal to a user's back. In such a position, the female coupler 130 of first lower strap 122 may be coupled to the male coupler 136 of first loop strap 134, and female coupler 132 of second lower strap 124 may be coupled to a male coupler 140 of second loop strap 138 (best seen in FIG. 6). It will be appreciated that the size-adjusting mechanism 142 of loop 133 functions to simultaneously tighten first and second loop straps 134, 138. In other words, the size-adjusting mechanism 142 may be actuated such that the circumference of stretchable loop 133 is smaller, which tightly secures the removably attachable reflective covering 100 to the backpack 121.

Therefore, for a larger-sized backpack, the circumference of the stretchable loop 133 can be increased. The stretchable loop 133 thereby allows quick and easy readjustment in size using a single mechanism, which is significantly easier than multiple strap configurations. While the stretchable loop 133 is preferable, it will be appreciated that other components may be used without departing herefrom, such as standard adjustable straps. The removably attachable reflective covering 100 may comprise any number of reflective materials known in the art such that it is highly reflective. The reflective materials may be on either or both of the front side 106 and back side. Further, it will be appreciated that the removably attachable reflective covering 100 may be brightly-colored, providing for high visibility during the daylight hours as well.

As appreciated from FIGS. 6-8, the backpack 121 is still highly accessible, despite the attachment of the removably attachable reflective covering 100. When a user desires to remove the removably attachable reflective covering 100 and store it, they may simply decouple it from the backpack 121 and, as best understood viewing FIGS. 2-5, insert the lower end 104 into the reversed void 112 of the upper end 102. This can be accomplished by inverting the void 112 to create a pouch where the removably attachable reflective covering 100 can be gathered and secured. Accordingly, the removably attachable reflective covering 100 functions as a cover and a storage bag for itself (as seen in FIGS. 4-5), overcoming problems in the prior art, particularly where storage bags and reflective covers are separable.

In one embodiment, a removably attachable reflective covering 100 comprises a device attachment site 144. A light 146 (and/or a GPS tracking device, which may be integrated into the light 146) which is removably attachable, or non-removable, can be coupled to the front side 106 of the removably attachable reflective covering 100 at the device attachment site 144. For example, the device attachment 144 site may comprise a receiver (best seen in FIG. 6) for receiving a spring-clamp of a light or GPS unit 146. The light 146 may be light-emitting diodes (LEDs) or any number of battery-operated lights. The GPS tracking device can also come in many forms, such as a handheld GPS tracking device or other known devices in the art of GPS. The light 146 allows the user to be easily seen during the day and during low-light conditions, or even when there is no reflective light from the reflective surface on front side 106. The GPS device can be useful in tracking and ensuring the safety of a user (e.g., a child) or may be used to track the backpack 121 in the event of a theft. It will be appreciated that either or both of the light 146 and GPS may comprise a transceiver and processor (e.g., microcontroller) so as to communicate with a wearer's smartphone, where the light 146 and GPS can be controlled via a smartphone application. For example, Bluetooth® or other wireless technologies may be used to effectuate the communication.

In one embodiment, a method of storing a removably attachable reflective covering 100 comprises forming a bag 115 by inverting a first end 102 and fitting the lower end 104 into the newly formed bag 115. For example, a void 112 may be formed at the upper end 102 of a removably attachable reflective covering 100, the void may then be inverted to receive the entire lower end 104, with a closing mechanism 114 engaged to secure the entire lower end 104 inside of the inverted void 112 and storage bag 115. The void 112 and the closing mechanism 114 creating the storage bag 115 for the removably attachable reflective covering 100, which provides packability and convenience for any user. As appreciated, this solves the problem in the art with reflective coverings being separated from their storage bags.

In one embodiment, a removably attachable reflective strap apparatus 200, as best shown in FIGS. 9-13, comprises a first strap 202 and a second strap 204. The first strap 202 and second strap 204 are configured to couple to one another, such as by using hooks and loops, buttons, snaps, or other mechanisms. In one embodiment, the first strap 202 may have an opening at the center thereof for receiving the second strap 204 therethrough. In one assembled configuration, the removably attachable reflective strap 200 has a cross formfactor. Further, each strap 202, 204 may be reflective or may be capable of having a reflective component coupled thereto. In one embodiment, as shown, a first reflective strap 206 may couple to first strap 202 and second reflective strap 208 may couple to second strap 204. This coupling may be achieved using any number of mechanisms, such as hooks and loops, buttons, snaps, etc. The removably attachable reflective strap apparatus 200 can be attached over a backpack 209 (FIGS. 12-13), or any other bag, by coupling the ends of the first strap 202 around the horizontal center or circumference of the backpack, from its front to back. The second strap 204 may be coupled around the vertical center of the backpack, from its top to bottom. While any coupling mechanism may be used to secure the ends of each strap 202, 204 to one another, respectively, hooks and loops are preferred. Hooks and loops allow the straps 202, 204 to be coupled at any given length, allowing for the removably attachable reflective strap 200 to be one-size-fits-all. Further, the reflective straps 206, 208 may comprise one or more colors, allowing customization for a user's needs and wants, allowing the removably attachable reflective strap apparatus 200 to be aesthetic.

Figure 11:
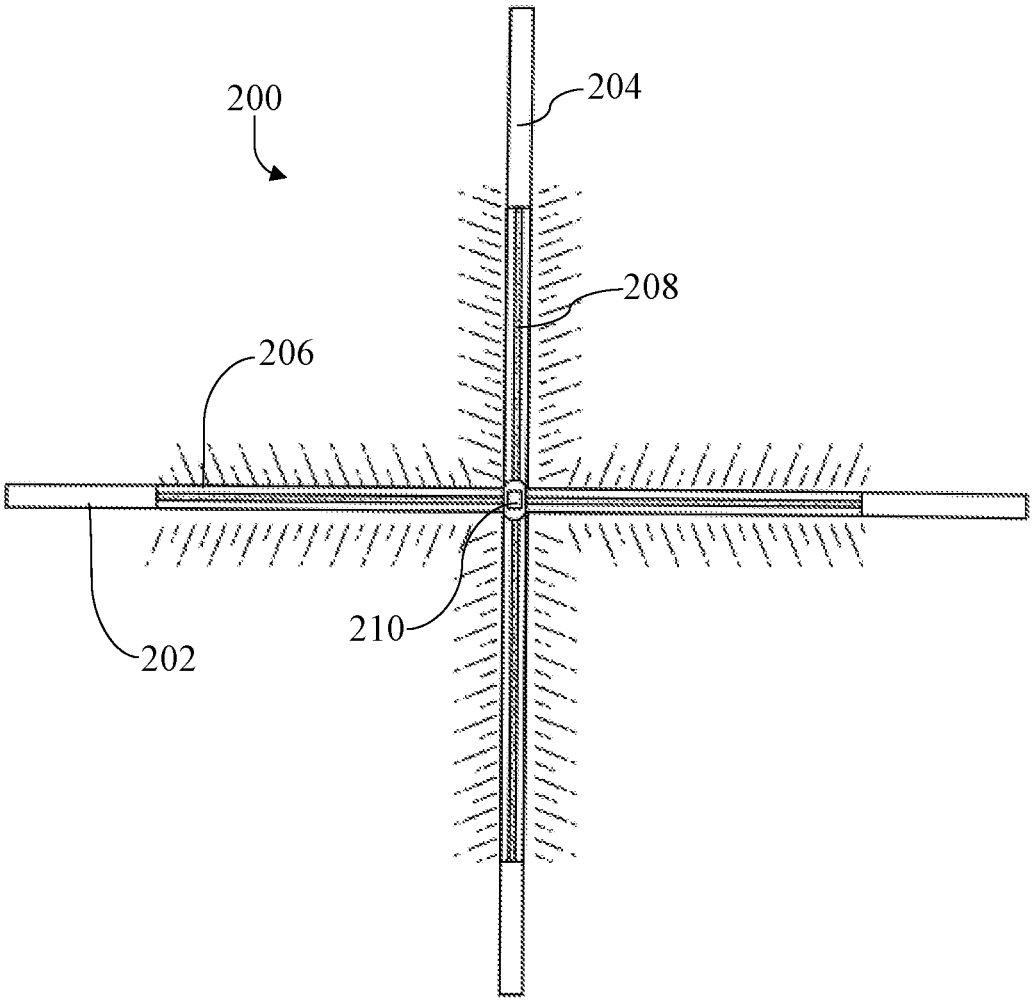
FIG. 11 is a front perspective view of a removably attachable reflective strap apparatus reflecting light.
Figure 12:
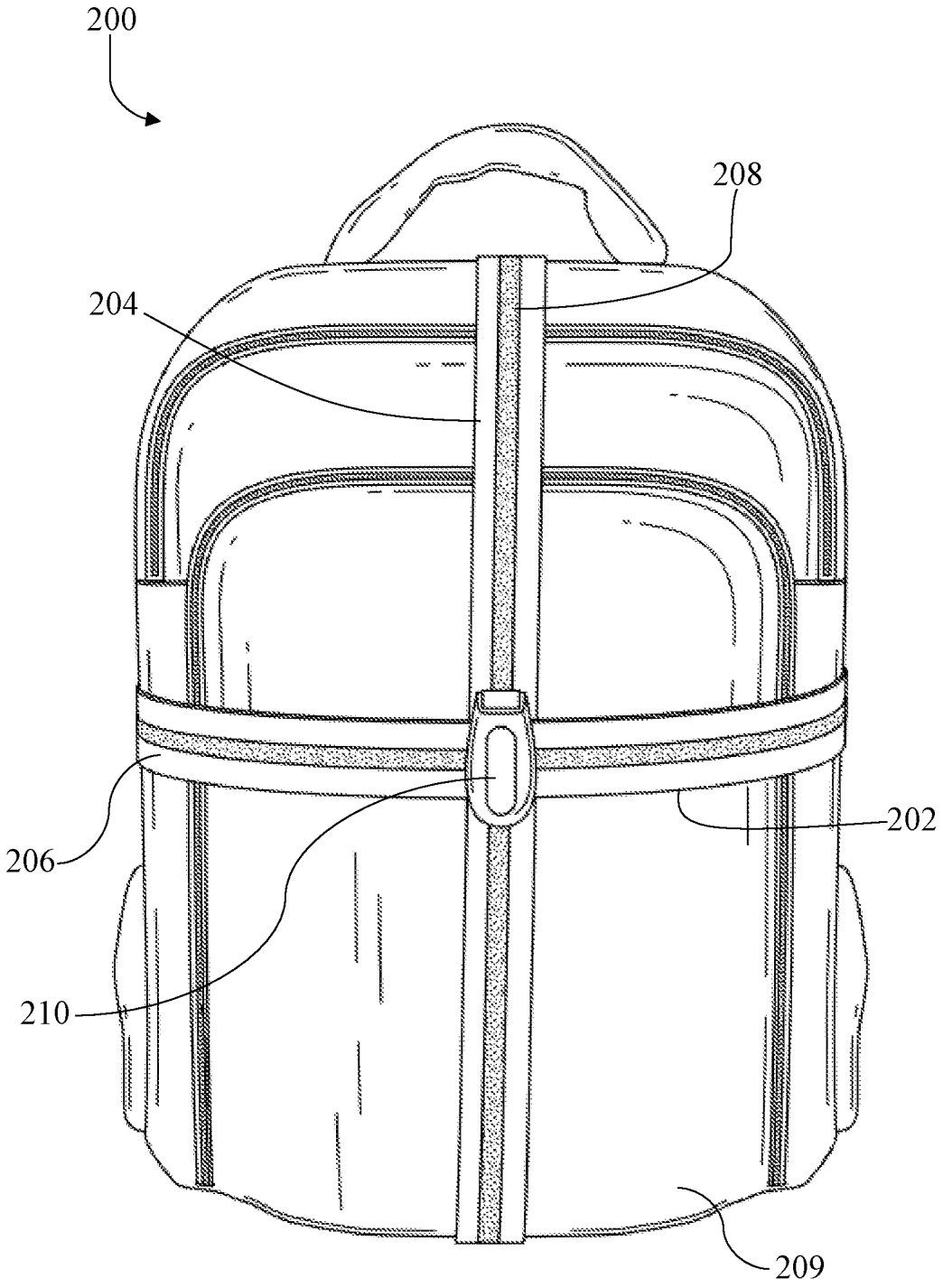
FIG. 12 is a front elevation view of a removably attachable reflective strap apparatus coupled to a backpack.
Figure 13:
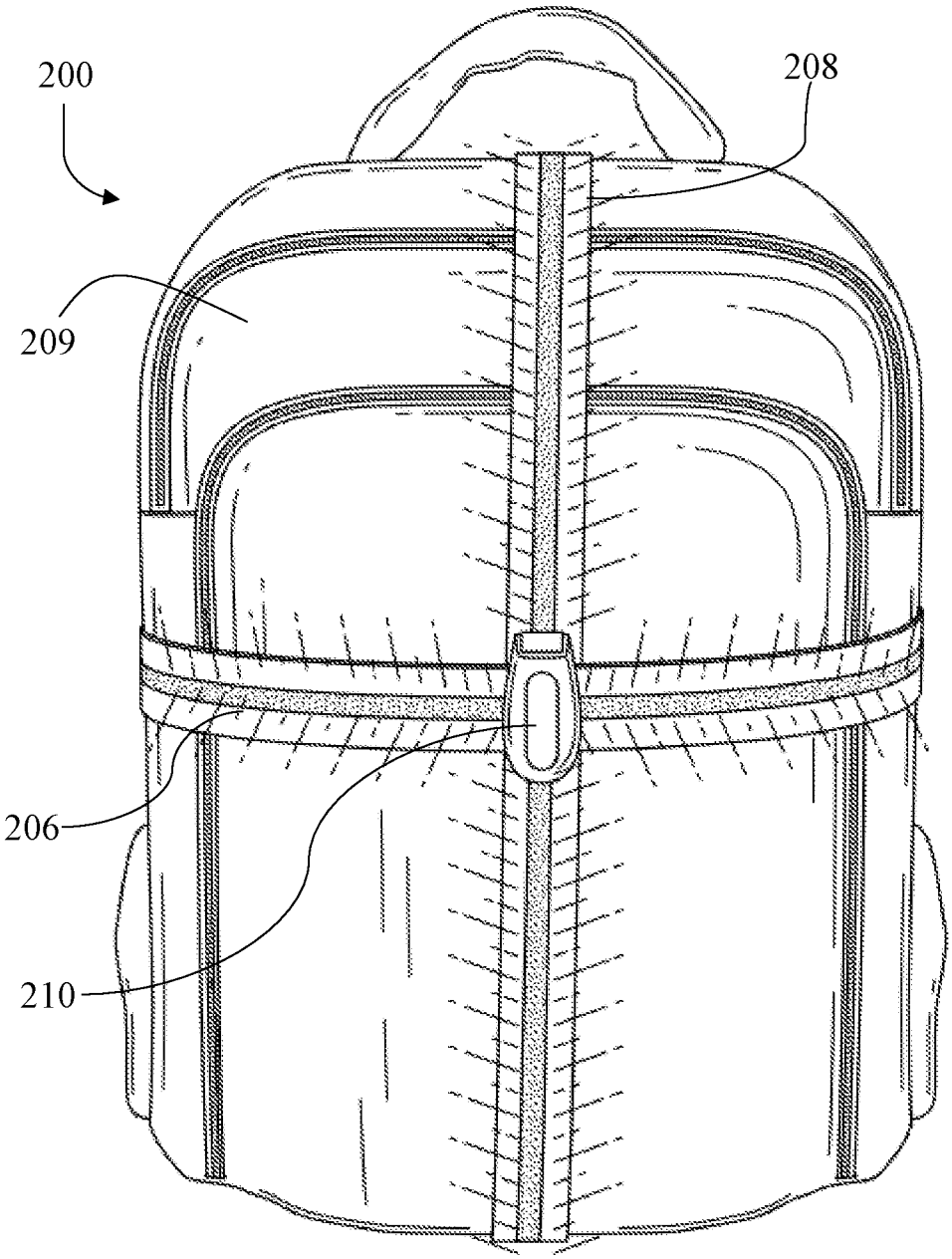
FIG. 13 is a front elevation view of an illuminated removably attachable reflective strap apparatus coupled to a backpack and reflecting light.

In one embodiment, a removably attachable reflective strap apparatus 200 comprises a light 210 that is removably attachable to the front side of either the first or second strap 202, 204. In one embodiment, the light 210 is coupled to the center of the cross formed by the first and second straps 202, 204. In one embodiment, a GPS unit may be coupled to the removably attachable reflective strap apparatus 200. It will be appreciated that while the light 210 and GPS unit are described herein as being removably attachable, it is not required. In other words, the light 210 and/or GPS unit may be non-removable. Like previous embodiments described herein, the light 210 and/or GPS may be capable of communicating with a user's smartphone for control (e.g., on/off, blink/constant light, etc.) It will be appreciated that FIGS. 11 and 13 are meant to illustrate reflecting light. For ease of component illustration, reflective lines were not included on FIGS. 1-8; however, it will be appreciated that all, or portions, of the removably attachable reflective covering 100 may be reflective.

Figure 14A:
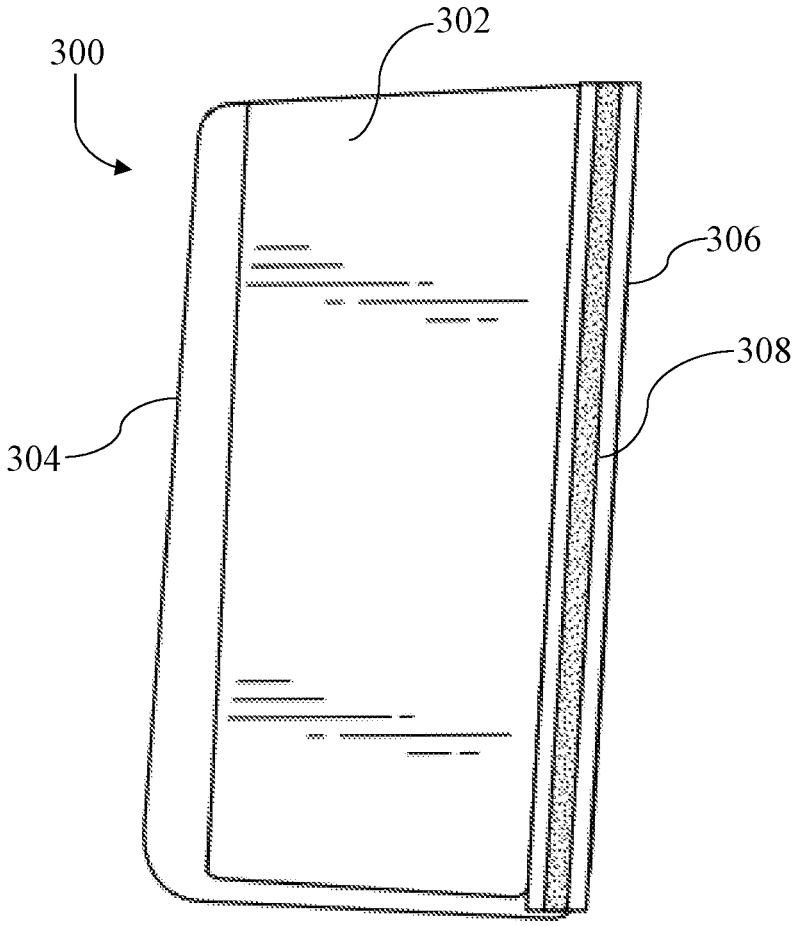
FIG. 14A is a front elevation view of a removably attachable reflective strap cover with a removable reflective strip attached.

Referring to FIG. 14A, in one embodiment, a removably attachable reflective strap cover 300 comprises malleable material (e.g., textiles) that can be attached over the straps of a backpack or other bag. For example, the removably attachable reflective strap cover 300 may have hooks and loops on a front side 302 and back side (not visible) of first edge 304 and hooks and loops on a front side 302 and back side (not visible) of second edge 306. The removably attachable reflective strap cover 300 may then surround or encompass the strap of a backpack where the first edge 304 may be coupled to the second edge 306 using the hooks and loops (e.g., the edge 304 of the front side 302 would contact the back side of edge 306 and would be coupled to one another using hooks and loops or similar mechanism). While hooks and loops may be the preferred coupling mechanism, any other attachment mechanism may be used, such as snaps, buckles, etc. Because both the front side 302 and back side comprise hooks and loops, the removably attachable reflective strap cover 300 is reversible. This allows a user to switch colors or graphics for aesthetic purposes simply by reversing the removably attachable reflective strap cover 300.

Figure 14B:
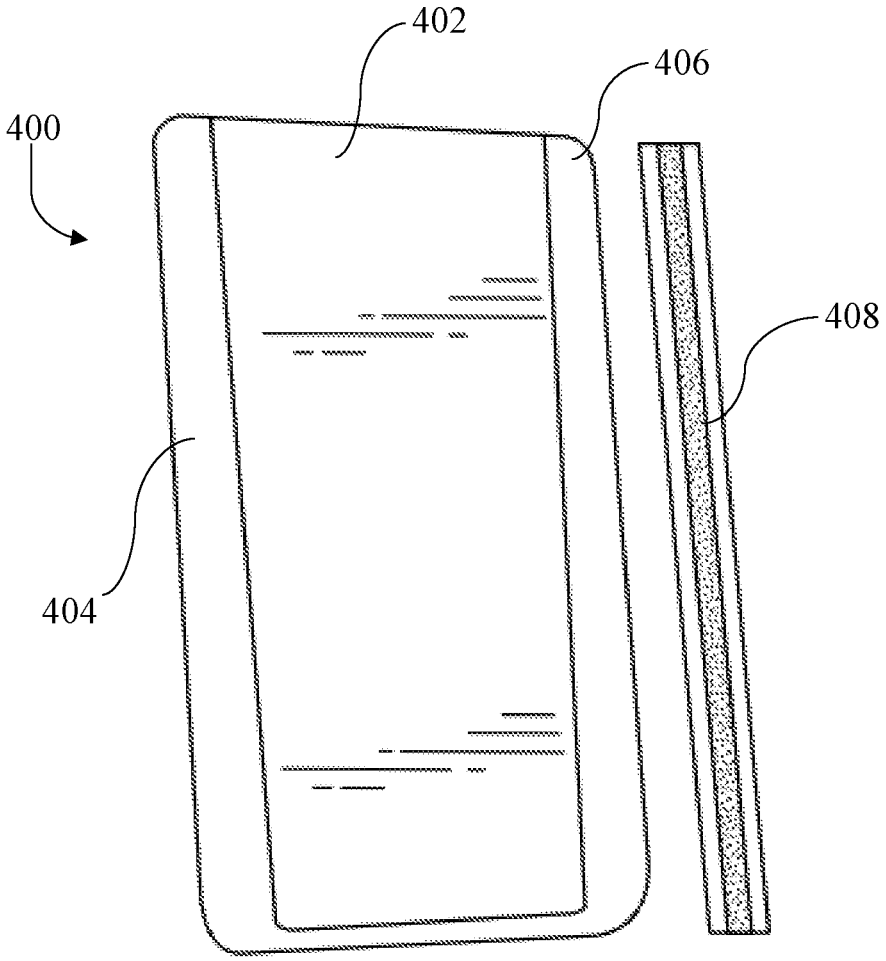
FIG. 14B is a front elevation view of a removably attachable reflective strap cover with a removable reflective strip detached.

FIG. 14B illustrates removably attachable reflective strap cover 400 with a removably attachable reflective strip 408 detached from the removably attachable reflective strap cover 400. Removably attachable reflective strip 408 can be attached to the removably attachable reflective strap cover 400 with any desired coupling mechanism. This allows a user to alternate colors or graphics to their desire. In one embodiment, the front side 302, 402 may comprise colors or graphics that differ from the back side. This allows a user to change colors or graphics to match the intended use. The removably attachable reflective strap cover 400 may have hooks and loops on a front side 402 and back side (not visible) of first edge 404 and hooks and loops on a front side 402 and back side (not visible) of second edge 406.

Figure 15:
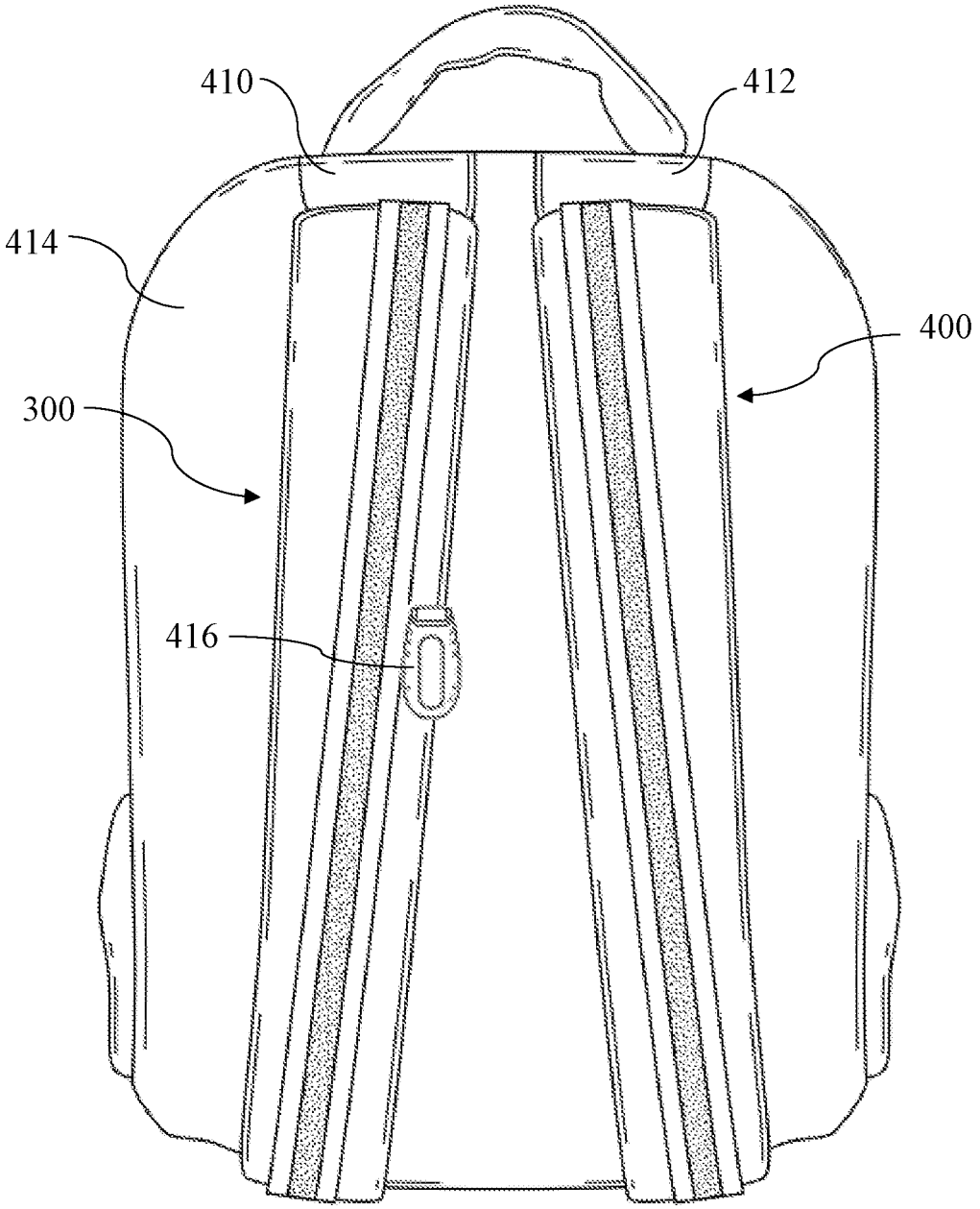
FIG. 15 is a front elevation view of two removably attachable reflective strap covers coupled to a backpack.

FIG. 15 illustrates the removably attachable reflective strap cover 300, 400 coupled to straps 410, 412 of backpack 414. As appreciated, the removably attachable reflective strap cover 300, 400 allow for colorization during the day and reflectiveness at night from the front-facing side of a user. Accordingly, when used in combination with the removably attachable reflective covering 100 or the removably attachable reflective strap apparatus 200, a wearer is easily visible to traffic in both directions, significantly increasing safety of the wearer. Further, the removably attachable reflective strap cover 300, 400 may further comprise a light and/or GPS unit 416, as similarly described in other embodiments herein.

It is appreciated from the foregoing that the removably attachable reflective covering 100, the removably attachable reflective strap apparatus 200, and the removably attachable strap cover 300, 400, overcome problems in the prior art by allowing for the use of a backpack without obscuring the reflective material, allowing it to be removed from one bag and attached to another bag, and maintaining access to the bag's compartments while reflective device 100, 200, 300, 400 is in use. The removably attachable reflective covering 100 also creates an effective storage system connected to the cover itself that is not seen in the prior art.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. A removably attachable reflective covering comprising:

a front side and a back side, the front side comprising reflective material, a light, and a GPS device;

an upper end comprising a first wall affixed to a second wall on a first upper edge, second upper edge, and third upper edge, with a fourth edge located at a top of the upper end forming a void between the first wall and second wall, the void having a closing mechanism; the upper end having a first upper strap connected to the first upper edge and a second upper strap connected to the second upper edge, the first upper strap and second upper strap each comprising a coupling device;

a lower end comprising a first lower strap connected to a first lower edge, a second lower strap connected to an opposite lower edge, and a third lower strap connected to a bottom edge, each of the first lower strap and second lower strap comprising a coupling device; the third lower strap comprising a stretchable loop coupled thereto;

the stretchable loop comprising a size-adjustment mechanism, a selectively positionable first loop strap, and a selectively positionable second loop strap, each of the first and second loop straps comprising a coupling device;

wherein the coupling devices of the first and second loop straps are configured to mate with the first lower strap and second lower strap of the lower end; and wherein the void is invertible so as to receive the lower end therein, forming a storage bag.

* * * * *